US006701811B1

(12) United States Patent
Chang et al.

(10) Patent No.: US 6,701,811 B1
(45) Date of Patent: Mar. 9, 2004

(54) SCREW FEEDING DEVICE

(75) Inventors: Shin-Nan Chang, Taichung (TW); ChUn-Chih Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/295,379

(22) Filed: Nov. 15, 2002

(51) Int. Cl.[7] ..... B25B 23/04
(52) U.S. Cl. ..... 81/434; 81/435
(58) Field of Search ..... 81/434, 435, 57.44, 81/57.31, 433; 173/93.5; 227/119, 120, 136

(56) References Cited

U.S. PATENT DOCUMENTS 5,402,695 A * 4/1995 Hornung ..... 81/434
6,073,523 A * 6/2000 Shinjo ..... 81/434
6,296,166 B1 * 10/2001 Huang ..... 227/119

* cited by examiner

*Primary Examiner*—Lee D. Wilson
(74) *Attorney, Agent, or Firm*—Charles E. Baxley

(57) ABSTRACT

A screw feeding device includes a one-piece member composed of a gar, a hollow shaft and a positioning gear, a one-direction bearing received in the hollow shaft and a biasing plate contacting the positioning gear. The one-piece member reduces the space occupied by the parts of the device. An adjusting shaft has a serrated surface at one end to contact a safety board and a plurality of notches in the other end of the adjusting shaft, the notches are engaged with a bead biased by a spring, thereby controlling a depth of the screw that penetrates in an object. The guide body of the device is composed of two halves so that the manufacturing cost is reduced.

1 Claim, 17 Drawing Sheets

SCREW FEEDING DEVICE

FIELD OF THE INVENTION

The present invention relates to a screw feeding device and more articularly, to a feeding device that has a compact size and includes an adjusting shaft for the safety board so that the device is easily to be assembled, operated and the depth of the screws can be controlled.

BACKGROUND OF THE INVENTION

A conventional screw feeding device known to the applicant is disclosed in U.S. Pat. No. 5,402,695 to Hornung and shown in FIGS. 1 to 4. The device includes a guide body 10 and a barrel 11 which is connected to the guide body 10 by a spring and includes a shaft 12 pivotably received therein. An end of the shaft 12 has an axle 14 for connecting two gears 13 and the other end of the shaft 12 is movably received in a slot 101 in the guide body 10. A positioning member 16 with a spring 15 are connected to the front end of the barrel 11. The shaft 12 swings in the slot 102 so as to let the two gears 13 drive the belt 18 with the screws 17. Notches 131 are defined in an inner side of each gear 13 and a one-direction valve 133 with a spring 132 are located between the two gears 13 so that the gears 13 can only rotate in one direction by the valve 133. The belt 18 and the screws 17 move in the direction and the positioning member 16 positions the belt 18.

Due to the movement of the two gears 13 is made by the swinging of the shaft 12, and the two gears 13 have to cooperate with the valve 133 and the positioning member 16 so that the whole assembly is complicated and involves too many parts. It requires complicated manufacturing processes to make the notches 131 in the two gears 13 and to install the spring 132 in the one-direction valve 133. The whole assembly occupies a lot of space. The belt 18 is not conveniently positioned because it is engaged with two gears 13. Furthermore, the cooperation between the swinging of the gears 13 and the positioning member 16 cannot be satisfied by the users.

SUMMARY OF THE INVENTION

The primary object of the present invention is to provide a screw feeding device that has a compact size and is easily to be assembled. A gear, a positioning gear and a hollow shaft are made into a one piece member and a one-direction bearing is received in the hollow shaft, a biasing plate is engaged with the positioning gear, thereby simplifying the structure of the device and may have a compact screw feeding device.

Another object of the present invention is that the screw feeding device may adjust the depth of the screws. An adjusting shaft is cooperated with a safety board, the adjusting shaft has an inclined surface which is engaged with a bead so as to be positioned precisely to achieve the purpose of micro-adjusting the depth of the screws.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 16 6hows a shallow depth of the screw is set to penetrate an object.

DETAILED DESCRIPTION OF THE PREFERRED EMBODIMENT

Figure 1:
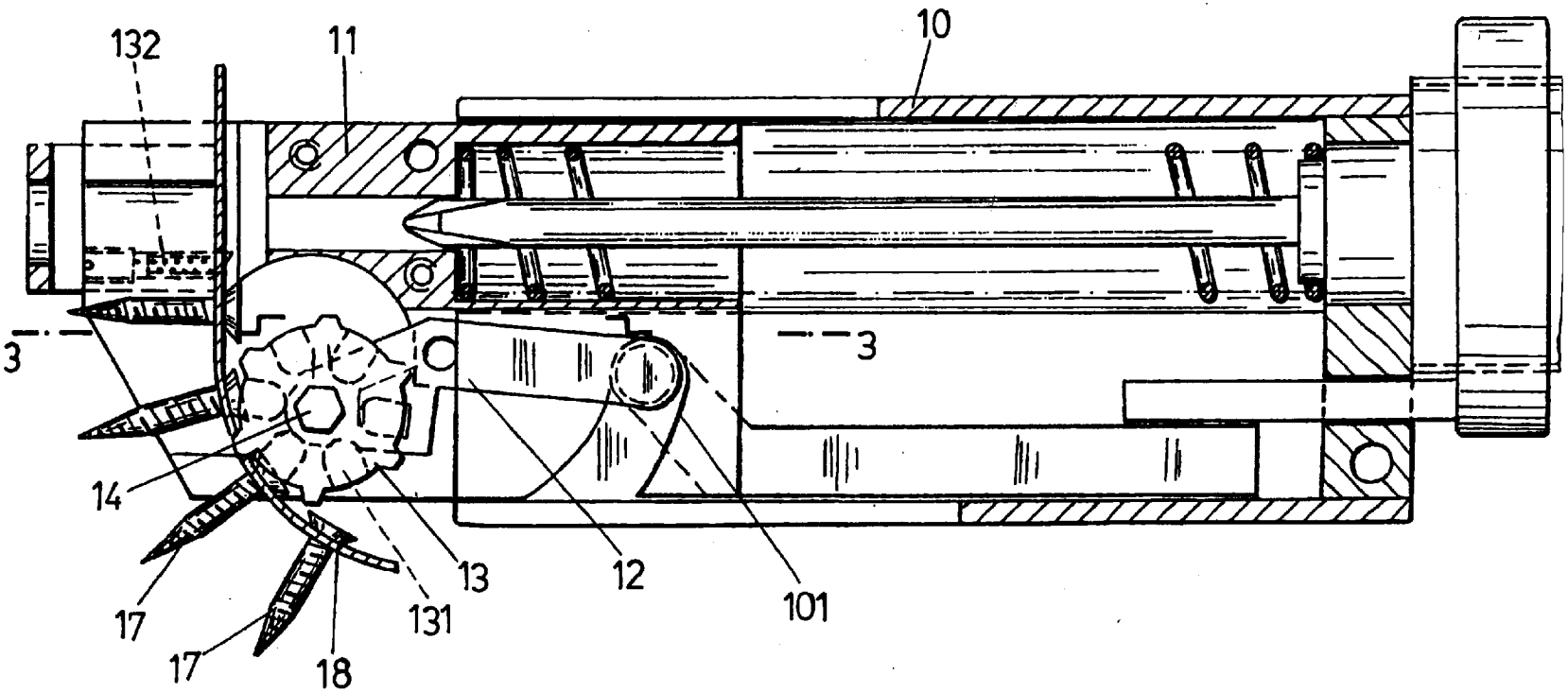
FIG. 1 PRIOR ART
FIG. 1 is a side view of a conventional screw feeding device.
Figure 2:
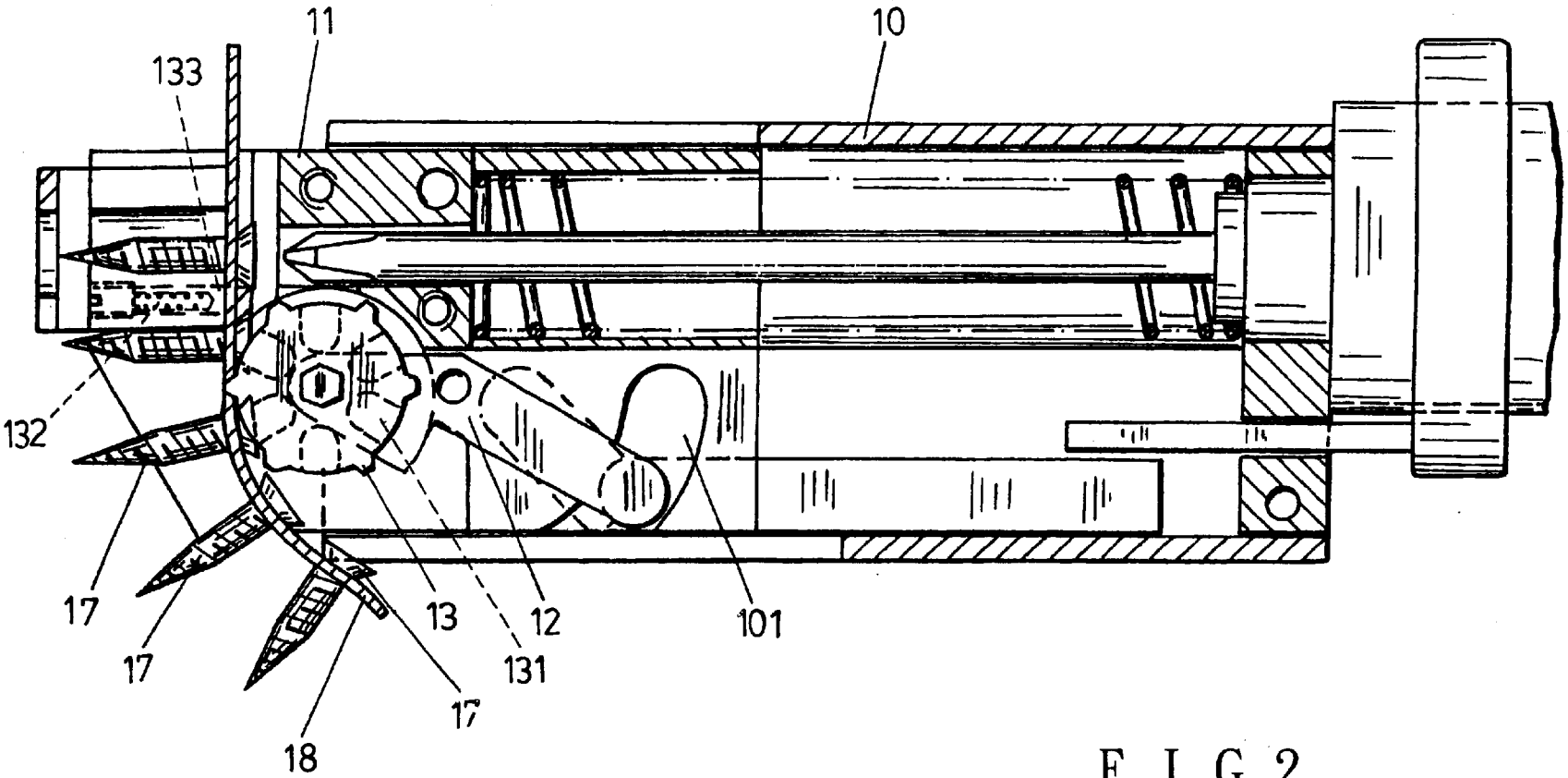
FIG. 2 PRIOR ART
FIG. 2 is a side view another status of the conventional screw feeding device.
Figure 3:
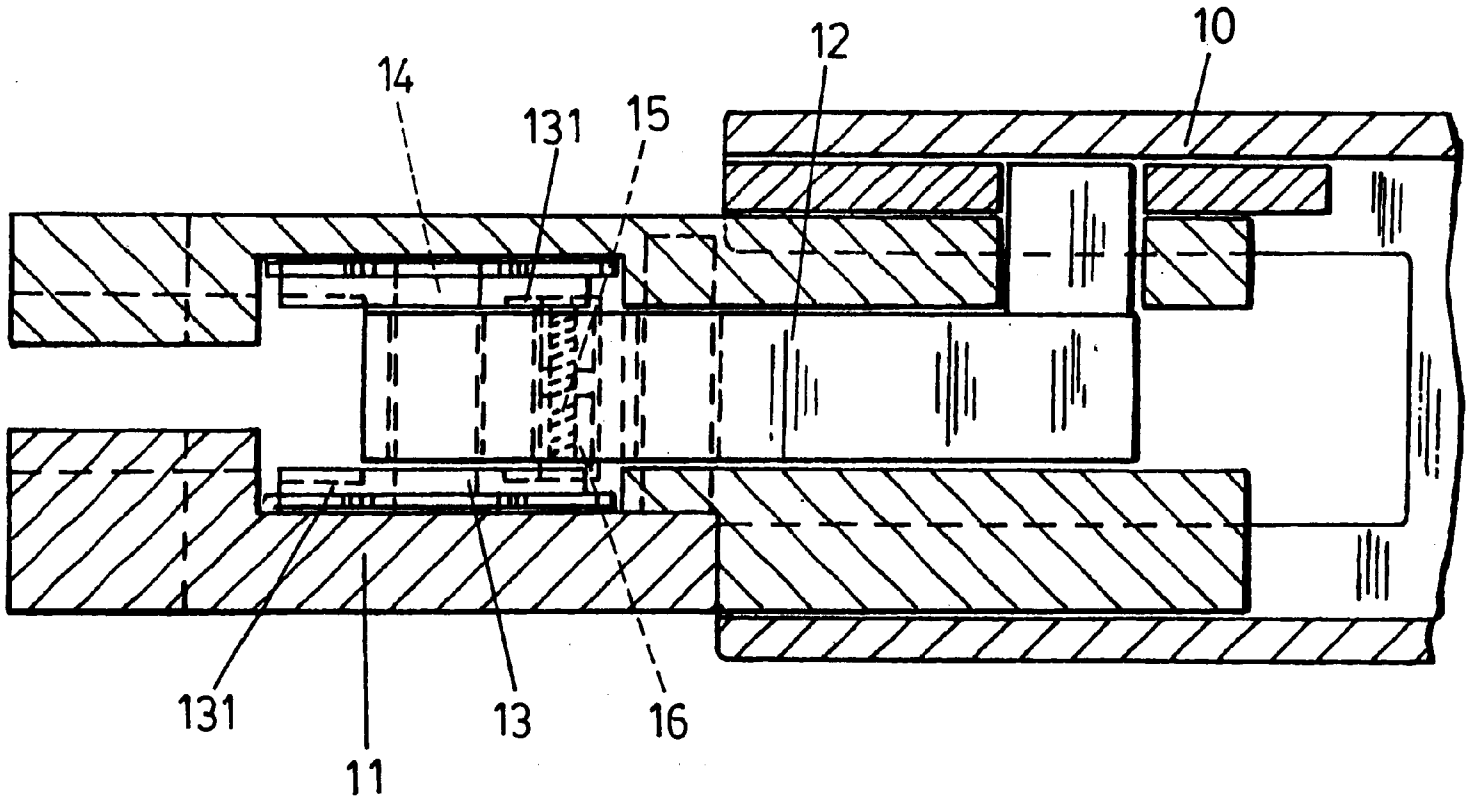
FIG. 3 PRIOR ART
FIG. 3 is a cross sectional view of the conventional screw feeding device.
Figure 4:
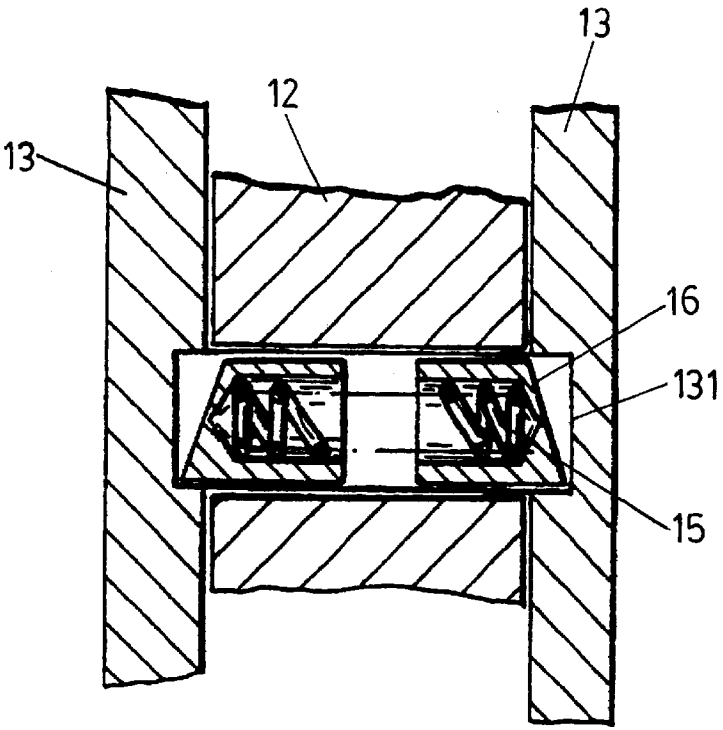
FIG. 4 PRIOR ART
FIG. 4 is another cross sectional view of the conventional screw feeding device.
Figure 5:
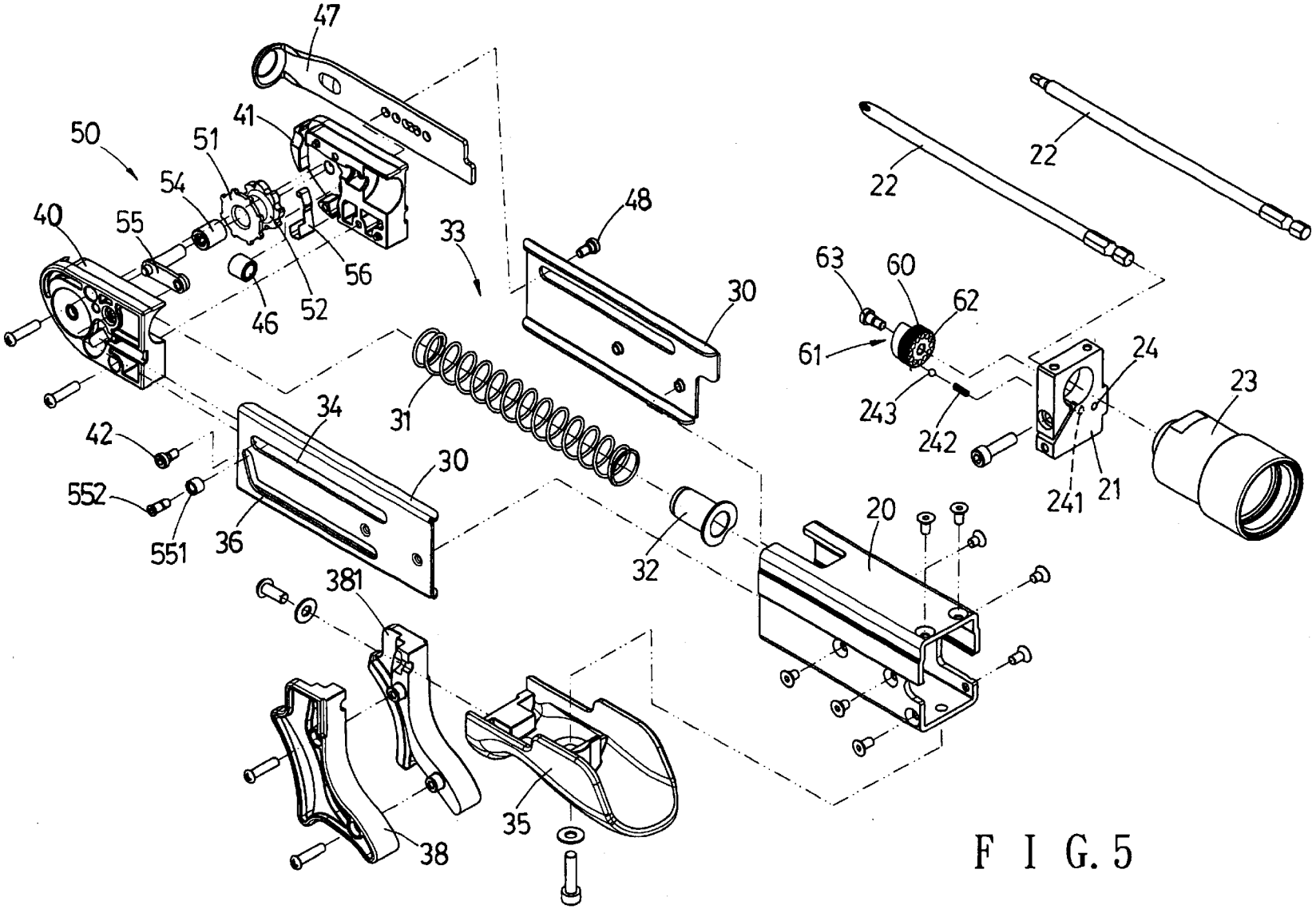
FIG. 5 is an exploded view to show the screw feeding device of the present invention.
Figure 6:
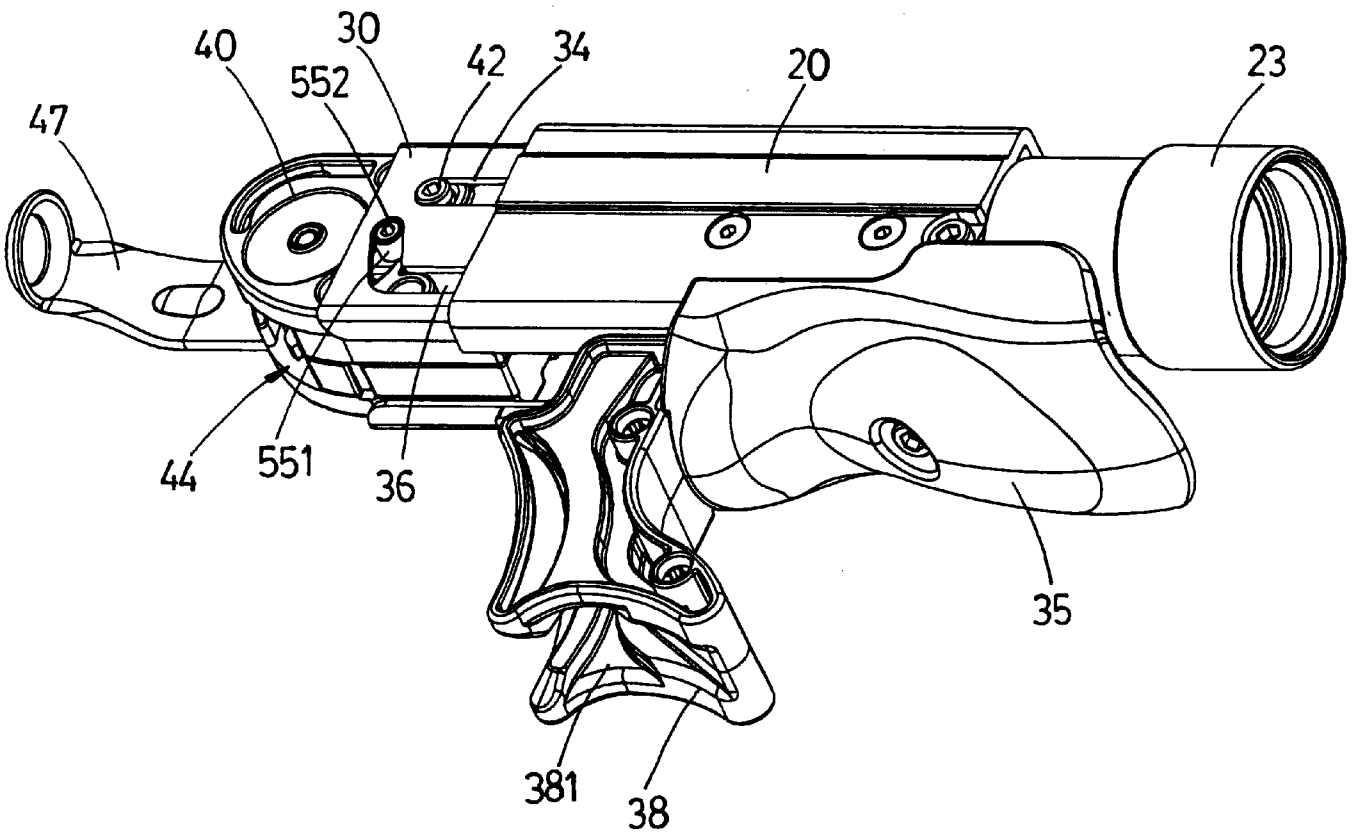
FIG. 6 is a perspective view to show the screw feeding device of the present invention.
Figure 7:
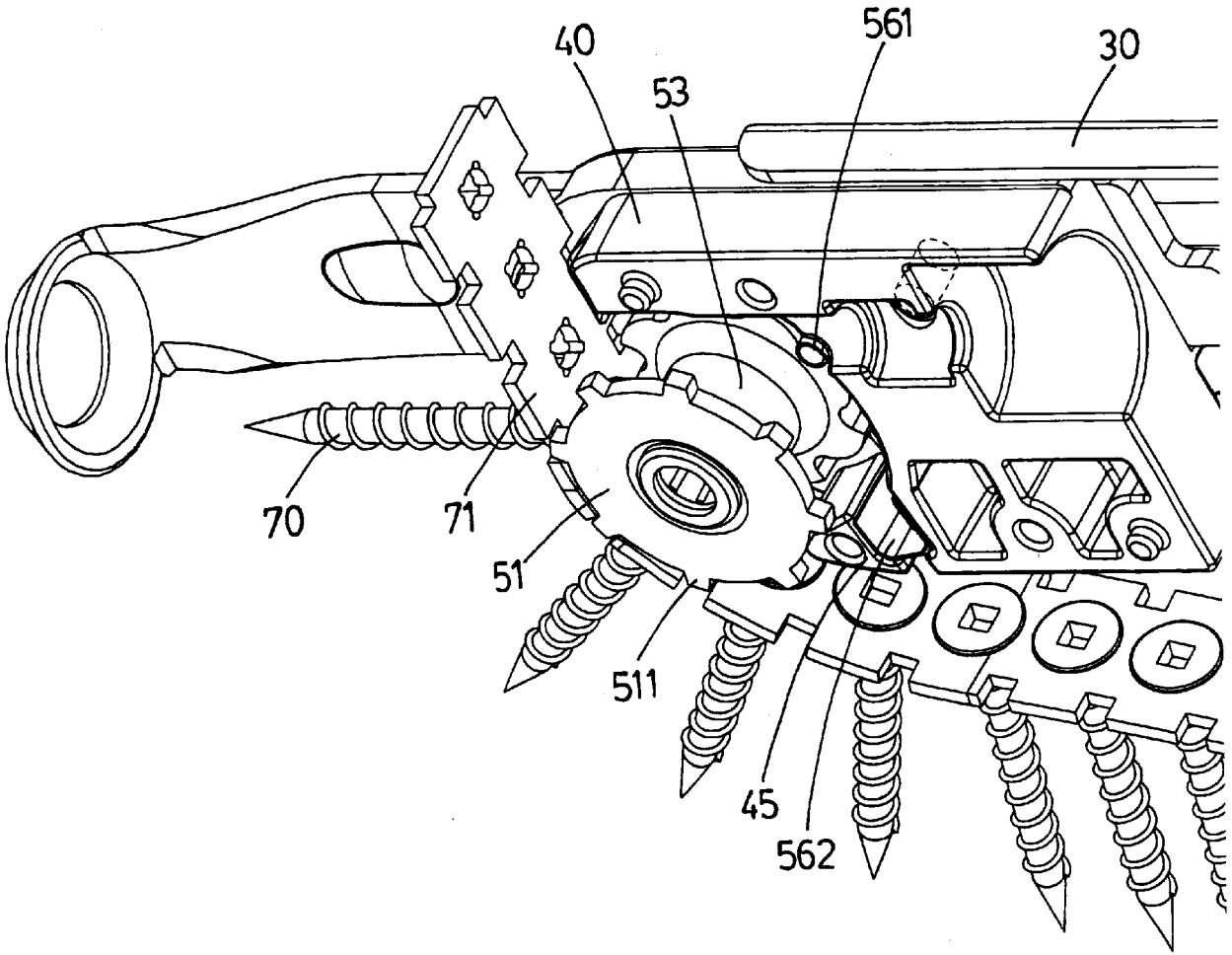
FIG. 7 is a perspective view to show a part of the screw feeding device of the present invention.
Figure 8:
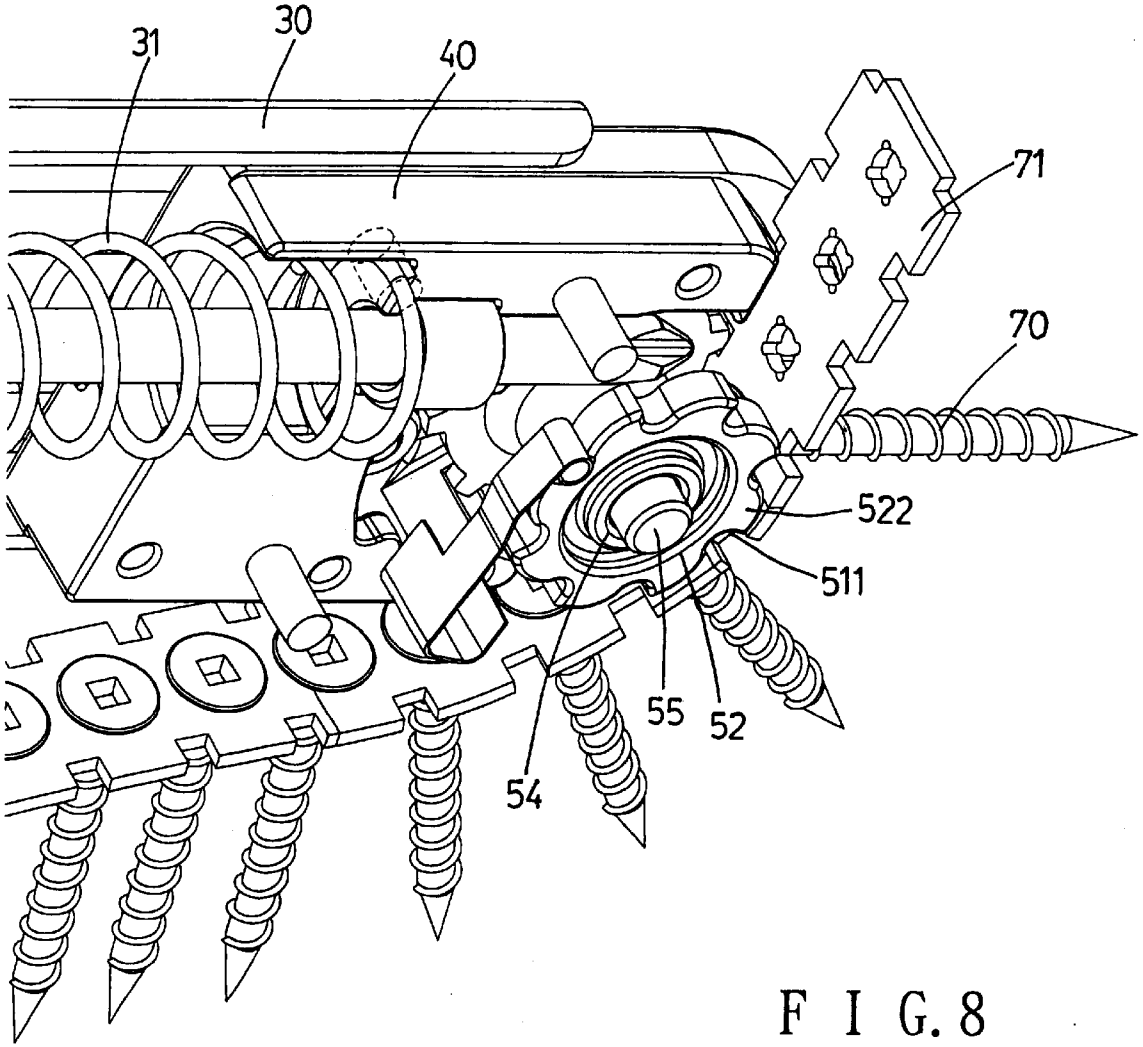
FIG. 8 is a perspective view to show another side of the part of the screw feeding device of the present invention.

Referring to FIGS. 5 to 8 and 17, the screw feeding device of the present invention comprises a guide frame 20, a guide body 30, a barrel 40, a screw pushing unit 50 and an adjusting shaft 60. A belt 71 to which a plurality of screws 70 is connected is operated by the device.

The guide frame 20 has a fixing block 21 on an end thereof and a fixing frame 23 is connected to the fixing block 21. A screw driving member 22 driven by an electric tool extends through the fixing block 21. A threaded hole 24 is defined in the predetermined position of the fixing block 21 and a recess 241 is defined beside the threaded hole 24. A spring 242 and a bead 243 which is biased by the spring 242 are received in the recess 241.

The guide body 30 is composed of two halves which are respectively connected to two insides of the guide frame 20. A spring 31 and a spring frame 32 are retained in the guide body 30 which has an opening 33 located in correspondence with the guide frame 20. A balance groove 34 and a curve groove 36 are respectively defined through the guide body 30. A screw guide plate 38 and a handle 35 are connected to the guide body 30. The screw guide plate 38 has a screw guide rail 381 defined therein which is located corresponding to the opening 33.

The barrel 40 is composed of two halves and an outlet 41 is defined in a front end of the barrel 40. A pin 42 extends through the balance groove 34 in the guide body 30 from a side of the barrel 40 so that the barrel 40 is reciprocatingly retained in the guide body 30 by the pin 42 and the spring 31. An action space 43 and a feeding space 44 are defined in an inside of the front end of the barrel 40. A positioning space 45 is located in correspondence with the action space 43 so that the action space 43, the outlet 41 and the feeding space 44 are located in correspondence with each other. The feeding space 44 is located in correspondence with the screw guide rail 381 of the screw guide plate 38. A bush 46 is received in the action space 43 and located corresponding to the screw driving member 22. A safety board 47 is connected to a side of the outlet 41 and includes a plurality of positioning holes 471. A positioning screw 48 extends through one of the positioning holes 471 and fixed to the side of the barrel 40. A contact protrusion 49 is formed at a rear end of the safety board 47.

The screw pushing unit 50 is received in the action space 43 and includes a gear 51, a positioning gear 52, a hollow shaft 53, a one-direction bearing 54, an axle 55 and a biasing plate 56. The gear 51, the positioning gear 52 and the hollow shaft 53 are made into a one-piece member and the teeth 511 on the positioning gear 51 are engaged with notches of the belt 71. The positioning gear 52 includes recesses 521 and curve blocks 522. The one-direction bearing 54 is inserted in the hollow shaft 53 and an end of the axle 55 is pivotably connected to the bearing 54. The other end of the axle 55 is in an L shape and a guide screw 552 having a pulley 552 are connected to the L-shaped end. The guide screw 552 employs the pulley 551 to be retained in the curve groove 36. The biasing plate 56 has a curve end 562 which is fixed in the positioning space 45 of the barrel 40 and the other end has a rounded end 561 which is in contact with the periphery of the positioning gear 52. The rounded end 561 is engaged with the recess 521 after it overcomes the resistance from the inclined surface of the curve block 522.

The adjusting shaft 60 is a circular block which has a serrated surface 61 at one end and the other end has a plurality of positioning notches 62. A screw 63 extends through the adjusting shaft 60 and is engaged with the threaded hole 24 of the guide frame 20. The positioning notches 62 contacting the adjusting shaft 60 is engaged with the bead 243 in the guide frame 20. The serrated surface 61 is located to face the contact protrusion 49 of the safety board 47.

Figure 9:
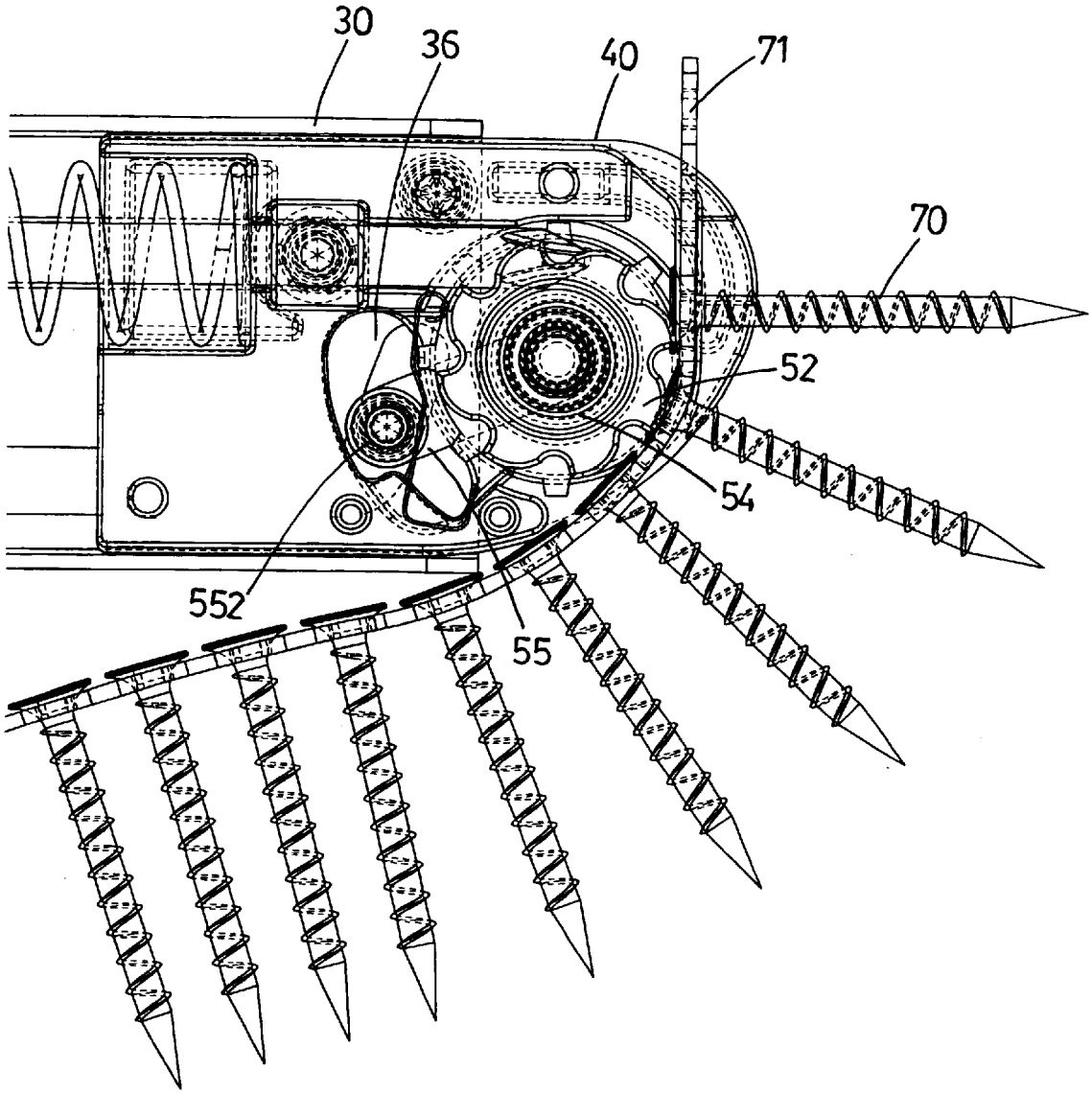
FIG. 9 is a side view to show a part of the screw feeding device of the present invention.
Figure 10:
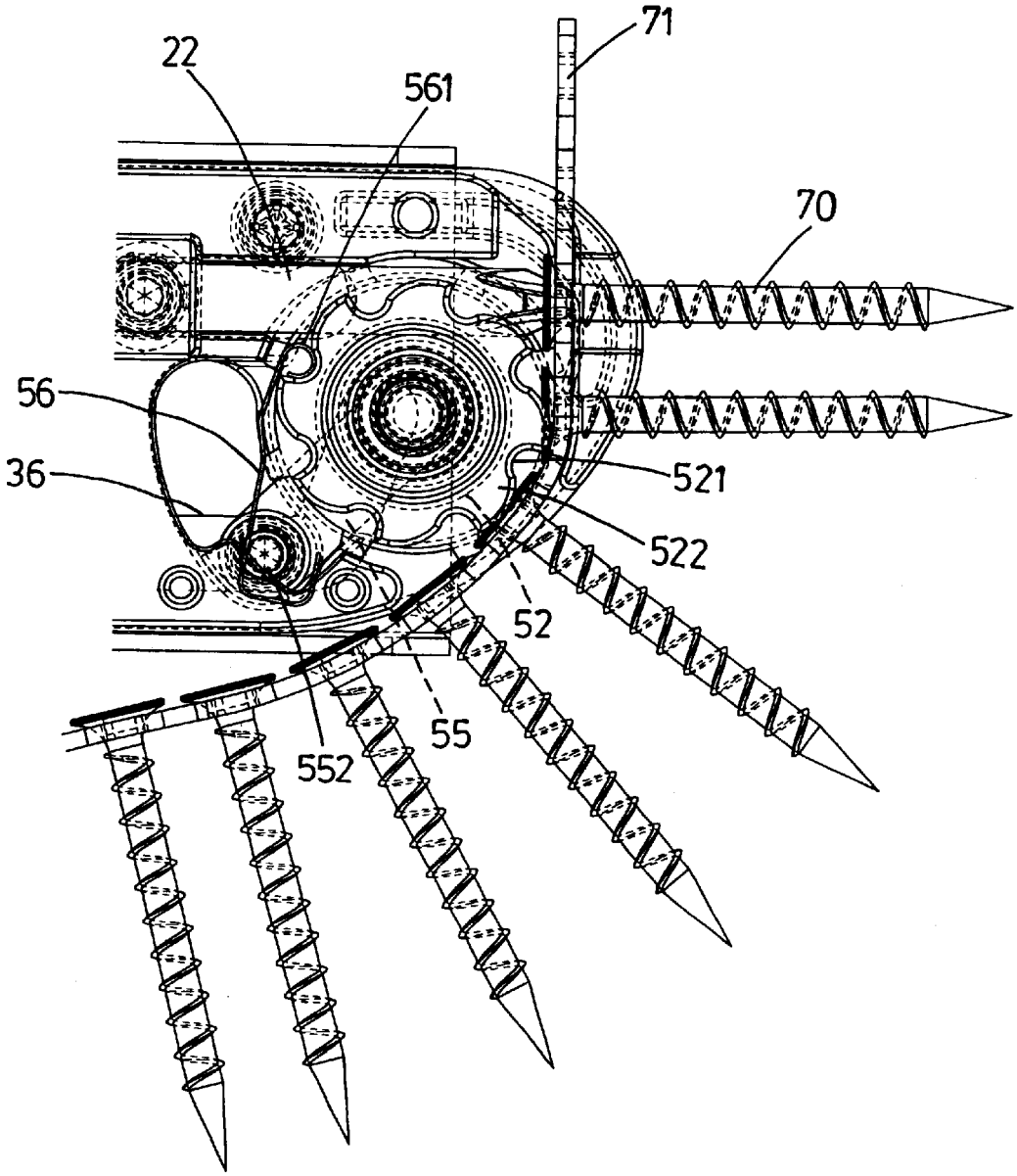
FIG. 10 is a side view to show another status of the part of the screw feeding device of the present invention.

Referring to FIGS. 9 to 13, in FIG. 9, the screw 70 is not yet fed to the firing position and the user holds the handle 35. The barrel 40 and the guide body 30 are in a relative retracted position, and the spring 31 is compressed. As shown in FIG. 10, the guide screw 552 of the axle 55 in the screw pushing unit 50 is moved by the curve groove 36 of the guide frame 20 to allow the axle 55 rotate the one-direction bearing 54 which rotate the hollow shaft 53. The gear 51 is rotated and drives the belt 71 to feed the screws 70. The gear 51 and the positioning gear 52 are completely rotated before the screws 70 are fired. The rounded end 561 of the biasing plate 56 will be engaged with the following recess 521 after the rounded end 561 overcomes the curve block 522 of the positioning gear 52. This positions the gear 51 and the positioning gear 52, in the meanwhile, a screw 70 is fed to the firing position.

Figure 11:
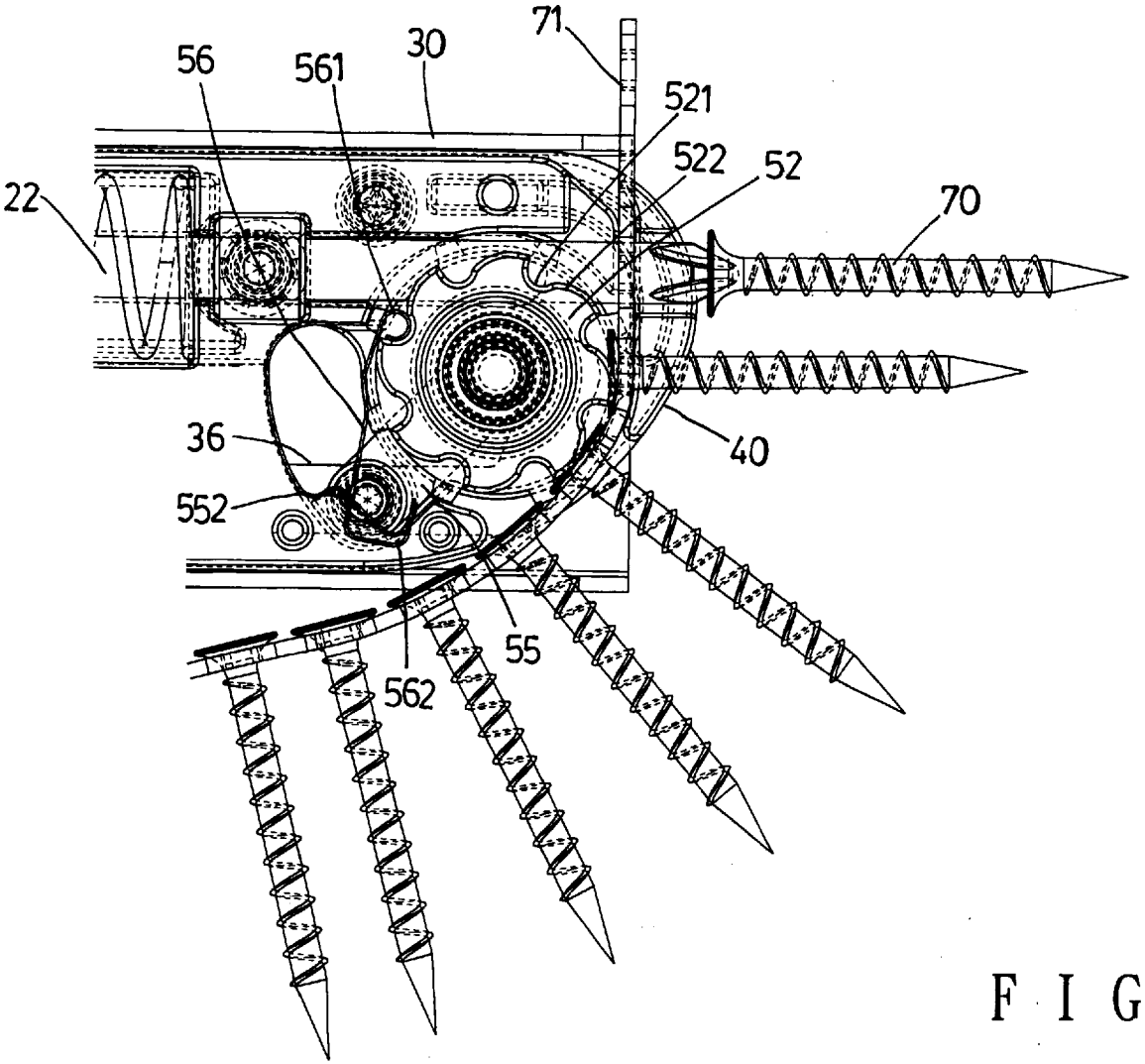
FIGS. 11 to 13 show side views of various status of the part of the screw feeding device of the present invention.
Figure 12:
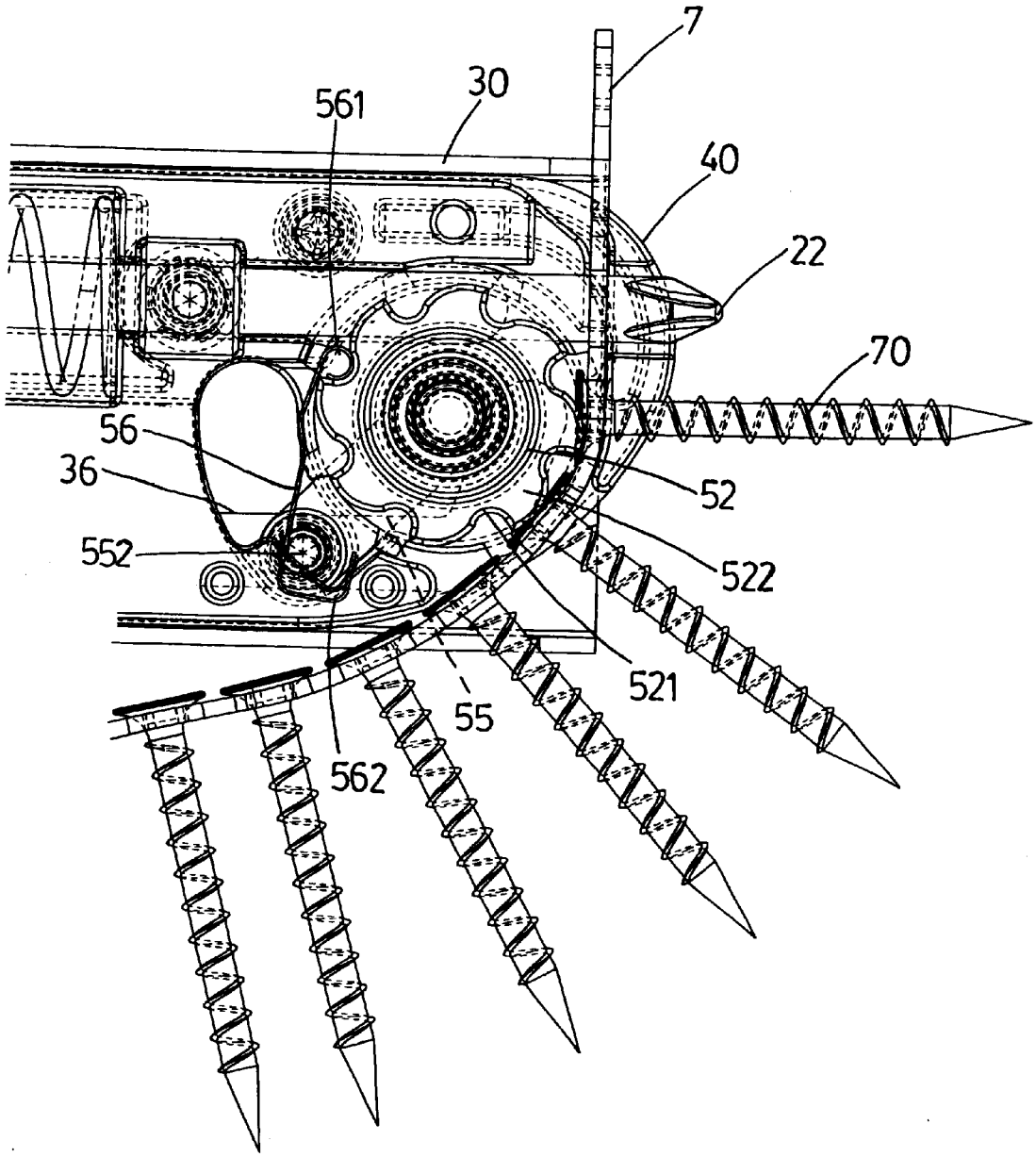

Referring to FIGS. 11, 12, after the screw 70 is positioned at the firing position, the screw driving member 22 rotates and pushes the screw 70 from the belt 71 and then is retracted in the guide body 30. In the meanwhile, the barrel 40 is still retracted in the guide body 30.

Figure 13:
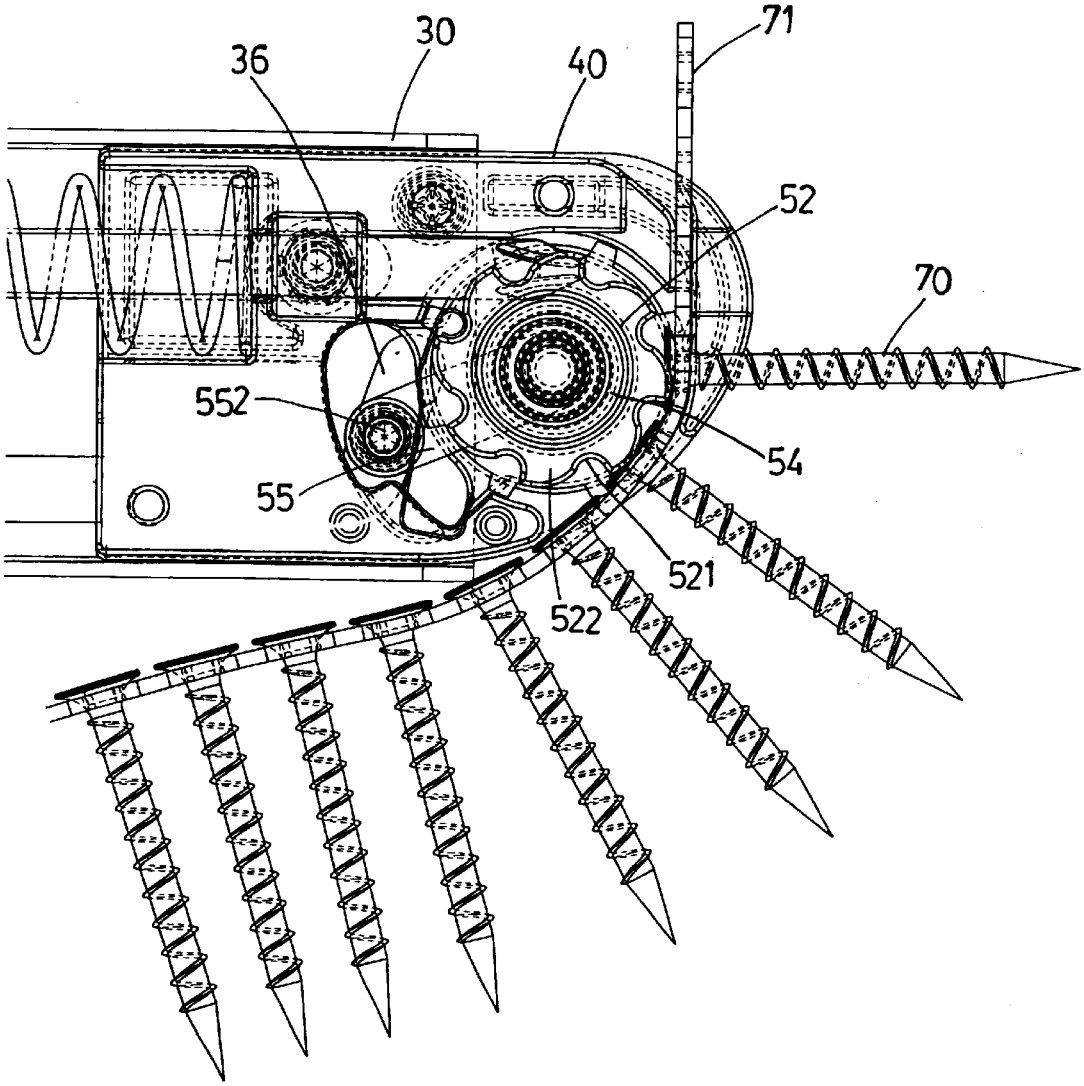

Referring to FIG. 13, after the handle 35 is released, the barrel 40 pops out from the guide body 30 by the spring 31 and the guide screw 552 of the of the axle 55 is driven by the curve groove 36 so as to rotate the bearing 54 in reverse which spins independently. In other words, the hollow shaft 53, the gear 51 and the positioning gear 52 are not rotated. Besides, the positioning gear 52 is stopped by the rounded end 561 of the biasing plate 56. Therefore, the positioning gear 52 is well positioned after the previous screw 70 is fired. The structure mentioned above simplifies the processes of assembly and the size of the whole assembly can be reduced.

It is to be noted that the structure of the one-piece member including the gear, the hollow shaft and the positioning gear, the one-direction bearing 54, axle 55, and the biasing plate 56 is so simple and can be made conveniently. The assembly of the one-direction bearing 54, the axle 55 and the biasing plate 56 simplifies the assembly for the manufacturers and performs even better than the conventional ones.

The safety board 47 at a side of the outlet 41 has positioning holes 471 which keeps a fixed distance for the outlet 41 to the object to be screwed so that different lengths of screws 70 can be used in the device by positioning the positioning screw 48 in one of the positioning holes 471.

Figure 14:
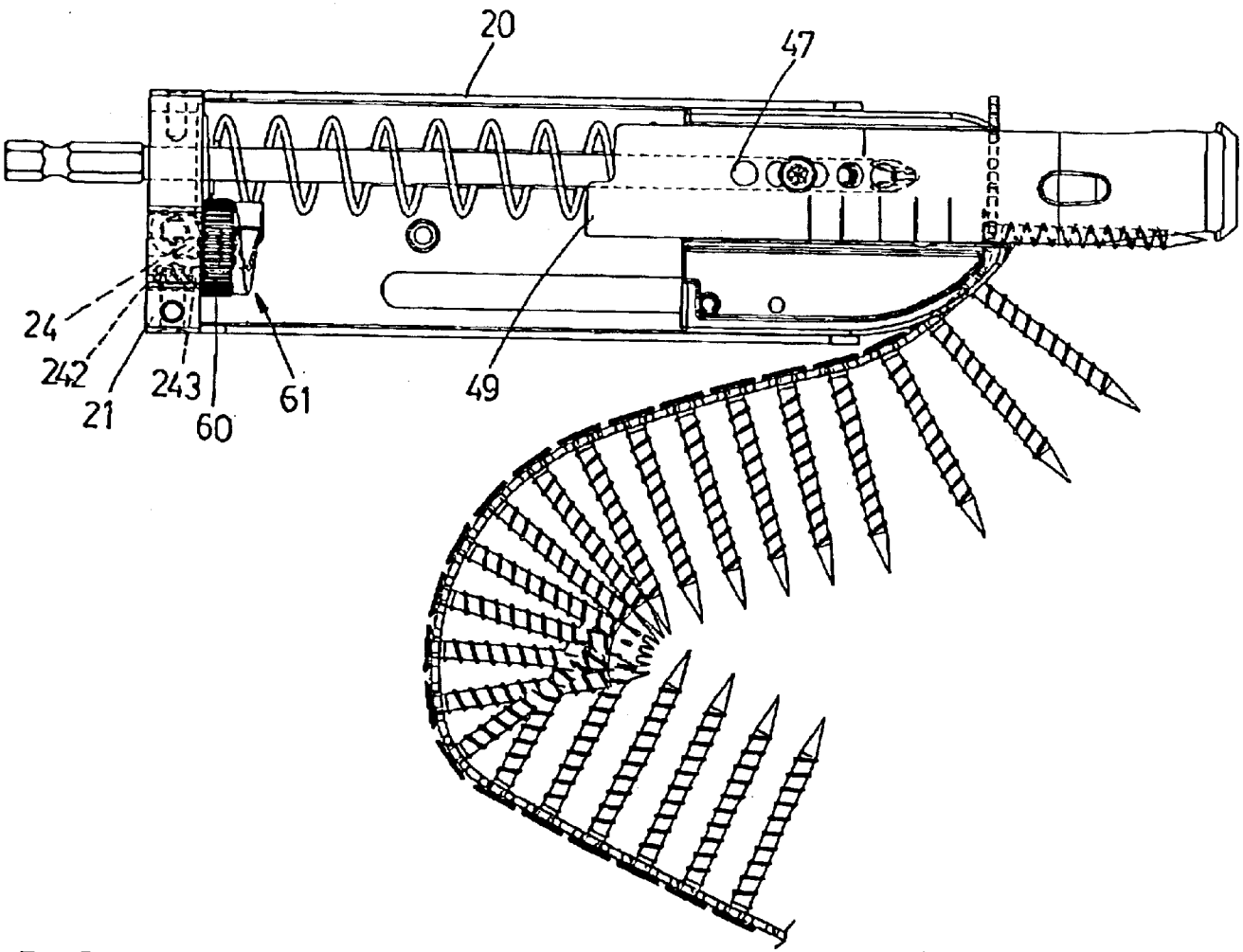
FIG. 14 shows a side view of the device of the present invention.
Figure 15:
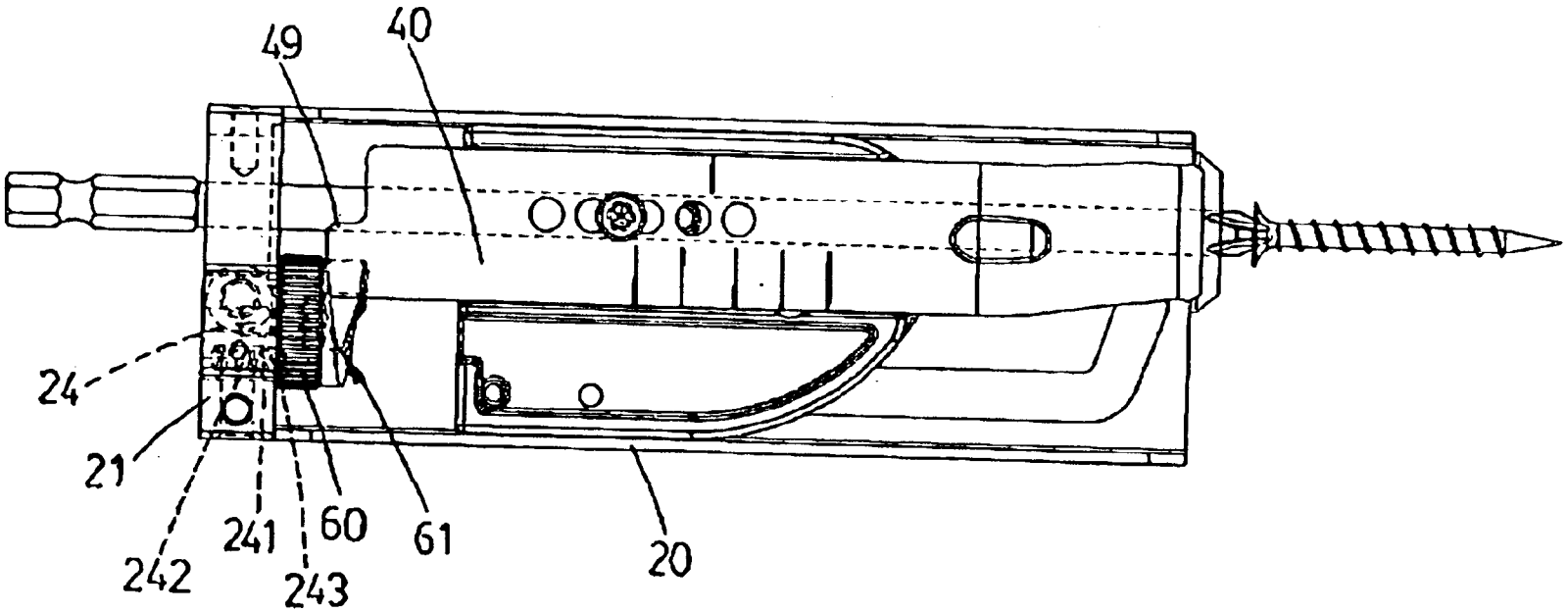
FIG. 15 shows a deep depth of the screw is set to penetrate an object.
Figure 16:
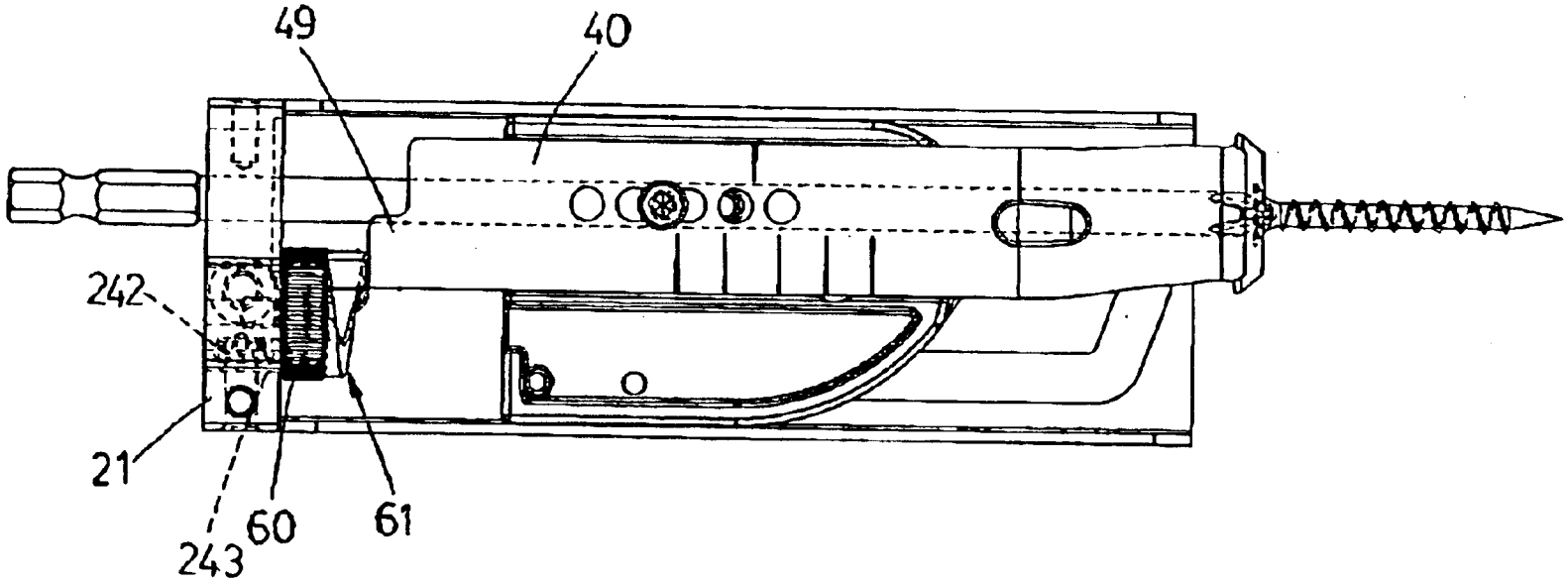
Figure 17:
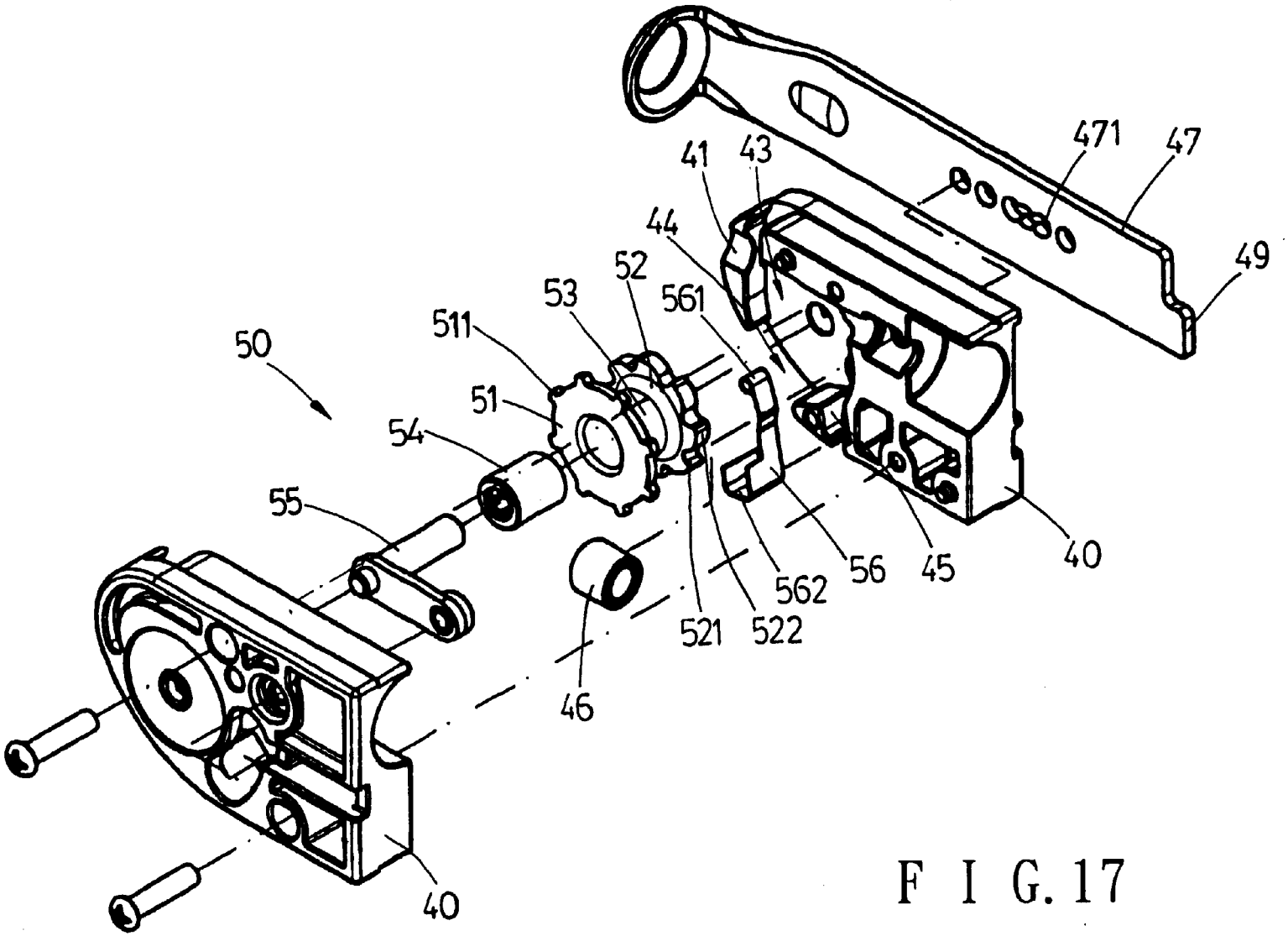
FIG. 17 shows an enlarged view of the part of the screw feeding device of the present invention.

As shown in FIGS. 14 to 16, the serrated surface 61 of the adjusting shaft 60 contacts against the contact protrusion 49 of the safety board 47 so that the depth that the screw 70 penetrates into the object can be controlled. The positioning notches 62 on the other end of the adjusting shaft 60 is cooperated with the bead 243 so as to micro-adjust the position that the screws 70 penetrate in.

While we have shown and described the embodiment in accordance with the present invention, it should be clear to those skilled in the art that further embodiments may be made without departing from the scope of the present invention.

What is claimed is:

1. A screw feeding device comprising:

a guide frame having a fixing block at an end thereof and a screw driving member extending through the fixing block;

a guide body fixed to the other end of the guide frame and a spring received in the guide body, an opening defined in a side of the guide body located in opposite to the guide frame, a balance groove and a curve groove defined in the guide body;

a barrel composed of two halves and an outlet defined in a front end of the barrel, a pin extending through the balance groove of the guide body and connected to the barrel so as to reciprocatingly retain the barrel in the guide body by the spring of the guide body and the pin, an action space and a feeding space defined in an inside of the front end of the barrel, a positioning space located corresponding to the action space, the action space, the outlet and the feeding space being located corresponding with each other;

a screw pushing unit received in the action space in the barrel and having an axle, one end of the axle pivotably connected to a one-direction bearing and the other end of the axle is an L-shaped end, a guide screw with a pulley being connected to the L-shaped end and the pulley being retained in the curve groove:

a threaded hole defined in the fixing block and a recess defined in a side of the threaded hole, a spring and a bead biased by the spring received in the recess;

the guide body composed of two halves;

the barrel having a safety board connected to a side of the outlet and a plurality of positioning holes defined through the safety board, a screw extending through one of the positioning holes and fixed to the side of the barrel, a contact protrusion located at an end of the safety board;

the screw pushing unit comprising a gear, a positioning gear, a hollow shaft, the one-direction bearing, the axle and a biasing plate, the gear, the positioning gear and the hollow shaft being a one-piece member and teeth of the gear adapted to be engaged with a belt, the positioning gear having curve blocks and recesses, the one-direction bearing inserted in the hollow shaft and a curve end of the biasing plate engaged in the positioning space of the barrel, the other end of the biasing plate is a rounded end which contacts a periphery of the positioning gear and engaged with one of the recesses of the positioning gear, and an adjusting shaft being a circular block which has a serrated surface at one end and the other end has a plurality of positioning notches, a screw extending through the adjusting shaft and being engaged with the threaded hole of the guide frame, the positioning notches contacting the adjusting shaft and engaged with the bead in the guide frame, the serrated surface located to face the contact protrusion of the safety board.

* * * * *